United States Patent [19]

Nicolls

[11] 4,073,276

[45] Feb. 14, 1978

[54] FUEL INJECTION PUMPING APPARATUS

[75] Inventor: Wilfrid Edward Walter Nicolls, East Molesey, England

[73] Assignee: Cav Limited, Birmingham, England

[21] Appl. No.: 660,665

[22] Filed: Feb. 23, 1976

[30] Foreign Application Priority Data

Mar. 4, 1975 United Kingdom ..... 8859/75

[51] Int. Cl.[2] ..... F02M 51/04; F04B 35/04

[52] U.S. Cl. ..... 123/139 E; 123/139 AL; 417/322

[58] Field of Search .... 123/139 E, 139 AL, 139 AM, 123/139 AN, 139 AS; 417/256, 265, 322, 465, 458, 258

[56] References Cited

U.S. PATENT DOCUMENTS

| | | | |
|---|---|---|---|
| 3,179,100 | 4/1965 | Glikin | 123/139 R |
| 3,598,506 | 8/1971 | O'Neill | 417/383 |
| 3,946,551 | 3/1976 | Linebrink et al. | 417/322 X |
| 3,983,855 | 10/1976 | Jarrett | 123/139 AS X |

*Primary Examiner*—Charles J. Myhre
*Assistant Examiner*—Tony M. Argenbright

[57] ABSTRACT

A fuel pumping apparatus comprises a rotary distributor member which is located in a housing. The distributor member mounts a pair of plungers which are moved inwardly to effect displacement of fuel from a bore to an outlet formed in the housing. Fuel is supplied to the bore from a cylinder which contains a piston actuated by a stack of piezo-electric crystals. The crystals are energized by a control circuit which is supplied with timing signals, actual engine operating parameters and demanded engine operating parameters.

5 Claims, 2 Drawing Figures

FUEL INJECTION PUMPING APPARATUS

This invention relates to fuel injection pumping apparatus of the kind comprising a rotary distributor member located within a housing and adapted to be driven in timed relationship with an associated engine, a delivery passage formed in the distributor member, and arranged to register in turn with a plurality of outlet ports in the housing, an injection pump which supplies a charge of fuel through said delivery passage each time the delivery passage registers with an outlet port, and means for supplying fuel to said injection pump.

The object of the invention is to provide such an apparatus in a simple and convenient form and in which the control of the fuel supplied by the apparatus is facilitated.

According to the invention, in an apparatus of the kind specified, said means comprises a pumping piston contained within a cylinder, a piezo-electric crystal unit for actuating said piston, first valve means operable to place said cylinder in communication with the injection pump, and second valve means through which said fuel can be supplied to said cylinder, the arrangement being such that when said valve means is opened, said crystal unit is energised to cause movement of the piston in the direction to displace fuel to the injection pump, the crystal unit being de-energised when said first valve means is closed, to move the piston in the opposite direction thereby to draw a fresh quantity of fuel into said cylinder by way of said second valve means.

One example of a fuel injection pumping apparatus in accordance with the invention will now be described with reference to the accompanying drawing in which.

Figure 1:
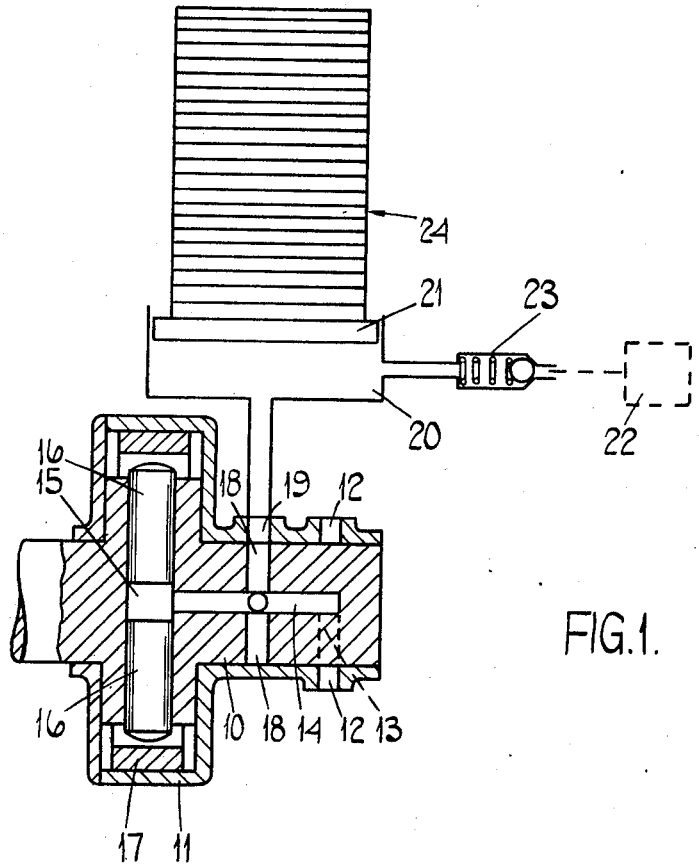
FIG. 1 shows in diagrammatic form the mechanical portion of the apparatus.

With reference to FIG. 1 of the drawing, there is provided a rotary cylindrical distributor member 10 which is located within a housing 11, and which is adapted to be driven in timed relationship with an engine with which the apparatus is associated.

Formed in the housing are a plurality of outlet ports 12 which are in communication respectively with injection nozzles mounted on the associated engine at positions so as to direct fuel into the respective combustion spaces of the engine. Moreover, formed in the distributor member is a delivery passage 13 which can register with the outlet ports in turn as the distributor member is rotated.

The delivery passage 13 communicates by way of a longitudinal passage 14, with a transversely extending bore 15 which is formed in the distributor member and which accommodates a pair of pumping plungers 16. The pumping plungers 16 at their outer ends, contact the internal peripheral surface of an annular cam ring 17 upon the internal periphery of which are formed in the particular example, two pairs of equi-angularly spaced and diametrically disposed cam lobes. The arrangement is such that as the distributor member rotates, the delivery passage 13 will be brought into register with one of the outlet ports 12 during the time when the plungers 16 are being moved inwardly, and in this manner a charge of fuel which is contained within the transverse bore 15, will be displaced through the outlet to the particular engine cylinder.

Also provided in the distributor member and communicating at their inner ends, with the longitudinal passage 14 are four equi-angularly spaced inlet passages 18, and these are arranged to register in turn, and during the time when the delivery passage 13 is out of register with an outlet port, with an inlet port 19 which is formed in the housing 11. The inlet passages together with said inlet port 19 comprise valve means as will appear from the operation hereinafter described. The inlet port 19 communicates with a cylinder 20 in which is located a pumping piston 21. Also communicating with the cylinder 20 is a source 22 of liquid fuel under pressure, there being interposed between the cylinder and the source of fuel, a spring loaded non-return valve 23. The piston 21 is connected to one end of a stack 24 of piezo electric crystals, and these can be caused to expand or contract to produce movement of the piston 21. The stack of crystals is energised by means of a control circuit not shown.

In operation, and with the apparatus in the position shown in the drawing, the inlet port 19 is in register with one of the inlet passages 18, and the stack of crystals has been energised to cause expansion thereof, and thereby displacement of a charge of fuel from the cylinder 20 into the bore 15. The movement of this fuel results in outward movement of the plungers 16, and the amount of fuel which is displaced to the bore 15 and which is subsequently delivered to the engine, can be determined by close control of the expansion of the stack of crystals. As the distributor member continues to rotate, the passage 18 moves out of register with the port 19 and the delivery passage 13 moves into register with an outlet port 12. When this occurs, the plungers are moved inwardly to displace the charge of fuel. Moreover, during this time, the stack of crystals is de-energised to produce outward movement of the piston 21, and this has the effect of drawing fuel into the cylinder 20 past the non-return valve 23. It will be appreciated that the spring which controls the non-return valve, has sufficient strength to prevent the valve opening under the action of the fuel under pressure delivered by the source.

Figure 2:
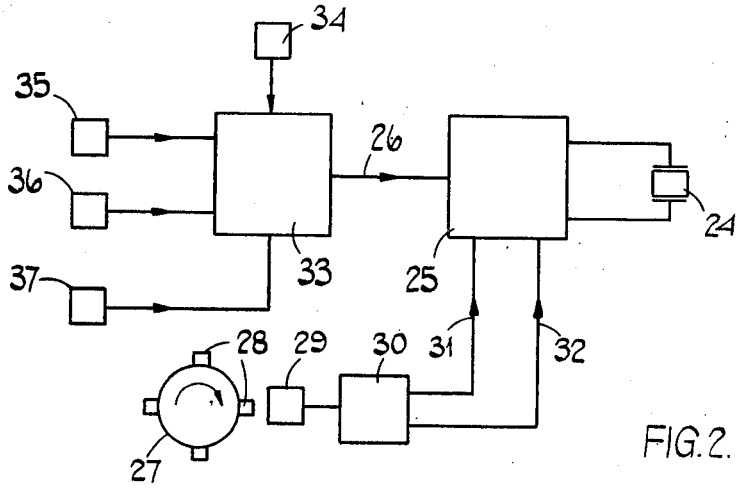
FIG. 2 shows in block form an electrical control circuit.

With reference now to FIG. 2. The stack of crystals is connected to a drive circuit 25 the action of which is to charge the stack of crystals at the appropriate time to cause expansion of the crystals and to discharge the crystals to cause contraction thereof at a later time. The magnitude of the charge and therefore the degree of expansion is determined by the amplitude of a control signal 26. Moreover, in order that the stack of crystals should be charged and discharged at the correct time signals 31 and 32 are applied to the drive circuit respectively.

In order to produce the signals 31, 32, a rotor 27 which is coupled to the distributor member 10 is provided with in the particular example, four projections 28. Also provided is a transducer 29 positioned so that the transducer will provide an output signal as each projection passes the transducer. Associated with the transducer is a shaping circuit 30 which provides the control signal 31 as the leading edge of a projection 28 is sensed by the transducer and the signal 32 as the trailing edge of the projections is sensed by the transducer. The projections are shaped so that the signals 31 and 32 occur at the correct time in relation to the opening of a passage 18 to the port 19.

The signal 26 is derived from a governing circuit 33 to which are fed various signals representing desired and actual engine operation parameters. In the particular case, the demand signal is a desired speed signal and is provided by a transducer 34, and an actual engine speed signal is provided by a transducer 35. The governing circuit acts to ensure that the actual speed of the engine so far as is possible, substantially equal to the demand speed. Additional inputs derived from circuits 36 and 37 act to limit the maximum speed of and the maximum fuel supplied to, the engine.

A pressurizing valve (not shown) may be provided in the conduit connecting the cylinder 20 and the port 19.

I claim:

1. A fuel injection pumping apparatus for an engine comprising a housing having a plurality of outlet ports, a rotary distributor member located within said housing and operatively connected with said engine so as to be driven in timed relationship with said engine, a delivery passage formed in the distributor member and arranged to register in turn with said outlet ports in said housing, an injection pump which supplies a charge of fuel through said delivery passage each time the delivery passage registers with an outlet port, means for supplying fuel to said injection pump comprising a cylinder, a pumping piston contained within said cylinder, a piezoelectrical crystal unit for actuating said piston, first valve means operable to place said cylinder in communication with said injection pump, and second valve means through which said fuel can be supplied to said cylinder, and a drive circuit for said crystal unit and a transducer for providing first and second signals to the drive circuit to energize and de-energize the crystal unit, a part rotatable with the distributor member, said transducer being positioned adjacent said part, the arrangement being such that when said first valve means is opened, said crystal unit is energized to cause movement of the piston in the direction to displace fuel to the injection pump, the crystal unit being de-energized when said first valve means is closed to move the piston in the opposite direction, thereby to draw a fresh quantity of fuel into said cylinder by way of said second valve means.

2. An apparatus according to claim 1, wherein said part has projections, and a shaping circuit is provided, said transducer passing a pulsed signal to the shaping circuit which derives said first and second signals from the leading and trailing edges of the pulses.

3. An apparatus according to claim 2, wherein a governor circuit is provided to which is fed signals representing desired and actual engine operating parameters, said governor circuit processing said signals to provide a fuel control signal which is received by said drive circuit.

4. An apparatus according to claim 1, wherein said first valve means comprises passage means and a single port formed in the distributor member and housing, respectively, said port communicating with said cylinder.

5. An apparatus according to claim 1, wherein said second valve means comprises a spring loaded non-return valve, communicating in use, with a source of fuel under pressure, the spring loading of the non-return valve being such that fuel can only flow into the cylinder when the piston is moved in the opposite direction.

* * * * *